US009900960B1

(12) United States Patent
Lin

(10) Patent No.: US 9,900,960 B1
(45) Date of Patent: Feb. 20, 2018

(54) DUAL COLOR TEMPERATURE-CONTROLLING SYSTEM

(71) Applicant: EXCELLENCE OPTO. INC., Miaoli County (TW)

(72) Inventor: Jhih-Siang Lin, Miaoli County (TW)

(73) Assignee: EXCELLENCE OPTO. INC., Hsinchu (TW)

( * ) Notice: Subject to any disclaimer, the term of this patent is extended or adjusted under 35 U.S.C. 154(b) by 0 days.

(21) Appl. No.: 15/400,080

(22) Filed: Jan. 6, 2017

(30) Foreign Application Priority Data

Dec. 14, 2016 (TW) ..... 105219039 U

(51) Int. Cl.
*H05B 37/02* (2006.01)

(52) U.S. Cl.
CPC ..... *H05B 37/0209* (2013.01)

(58) Field of Classification Search
CPC ..... H05B 37/0209; G02B 6/00
USPC ..... 315/210
See application file for complete search history.

(56) References Cited

U.S. PATENT DOCUMENTS 8,267,541 B2 * 9/2012 Watanabe ..... F21S 8/086 362/153
2008/0080178 A1 * 4/2008 Kita ..... F21S 8/086 362/231
2012/0057341 A1 * 3/2012 Block ..... F21S 6/006 362/234
2012/0106156 A1 5/2012 Scott et al.
2013/0043801 A1 * 2/2013 Kuwu ..... H05B 33/0863 315/210
2016/0088697 A1 * 3/2016 Yan ..... H05B 33/0818 315/205
2016/0286629 A1 * 9/2016 Chen ..... H05B 37/0272

FOREIGN PATENT DOCUMENTS

WO WO 2011049976 A1 * 4/2011 ..... H05B 33/0809

* cited by examiner

*Primary Examiner* — Dylan White
(74) *Attorney, Agent, or Firm* — Muncy, Geissler, Olds & Lowe, P.C.

(57) ABSTRACT

A dual color temperature-controlling system, electrically connected to a brightness controlling module of a street light, includes a power supply controlling module, a switching module, a first and a second color temperature light emitting modules, and a comparing module. The switching module is electrically connected to the power supply controlling module. The first and the second color temperature light emitting modules are electrically connected to the switching module. The comparing module is electrically connected to the switching module. A voltage-type operating signal sent from the brightness controlling module is received by the comparing module for comparison, and a switching signal is then sent to the switching module. The switching module is switched for lighting up the first or second color temperature light emitting module depending on the switching signal. Thereby, color temperature of the street light is changed so as to enhance safety of road occupant.

6 Claims, 3 Drawing Sheets

DUAL COLOR TEMPERATURE-CONTROLLING SYSTEM

The present invention is related to a color temperature-controlling system, particularly to a dual color temperature-controlling system.

BACKGROUND OF THE INVENTION

In lighting systems, having become an indispensable part in modern life, a variety of light sources are used for the enhancement of brightness in specific sites. Further, as technology advances, certain requirements for brightness, color temperature, light distribution pattern and etc., needed in each site, especially in sites involving personal safety are provided. Thus, there are strict requirements for street lights, vehicle lamps and so on.

A street light, such as "Street light led" disclosed in U. S. patent US20120106156, comprises a pole, a solid state light emitting device provided on the pole, and an optical element provided on the pole. A light is emitted from the solid state light emitting device. Moreover, a light distribution pattern complying with requirements may be produced from the light by the optical element and then emitted.

Only one single color temperature, however, is inherent in such a kind of street light. It is possibly not clear enough in general conditions, if warm color temperature is used. Nevertheless, it is clearer if cool color temperature is used, in comparison with warm color temperature, though the problem of poor visibility occurs because the cool light is apt to be reflected by water vapor in the rain or mist. Therefore, how to change color temperature of the light source according to the external environment is truly the topic with which the industry is confronted.

SUMMARY OF THE INVENTION

It is the main object of the present invention to solve the problem of incapability of changing color temperature according to the external environment.

For achieving the above object, the present invention provides a dual color temperature-controlling system mounted on a street light and electrically connected to a brightness controlling module of the street light. The dual color temperature-controlling system includes a power supply controlling module, a switching module, a first color temperature light emitting module, a second color temperature light emitting module and a comparing module. The switching module is electrically connected to the power supply controlling module. The first color temperature light emitting module and the second color temperature light emitting module are electrically connected to the switching module. The comparing module is electrically connected to the switching module and the brightness controlling module. A voltage-type operating signal sent from the brightness controlling module is received by the comparing module for comparison, and a switching signal is then sent from the comparing module to the switching module. The switching module is switched for lighting up the first color temperature light emitting module, or for lighting up the second color temperature light emitting module depending on the switching signal.

To sum up, the present invention is provided with features as follows:

1. Color temperature of the street light may be changed according to the external environment by switchingly lighting up the first color temperature light emitting module or the second color temperature light emitting module depending on the voltage-type operating signal, for the enhancement of safety of road occupant.

2. The voltage-type operating signal sent from the brightness controlling module originally provided in the street light is used directly for controlling the first color temperature light emitting module or the second color temperature light emitting module to be lighted up, without additional modules for sensing the external environment, so as to reduce the cost.

DETAILED DESCRIPTION OF THE PREFERRED EMBODIMENTS

The detailed description and technical content of the present invention will now be described in combination with drawings as follows.

Figure 1:
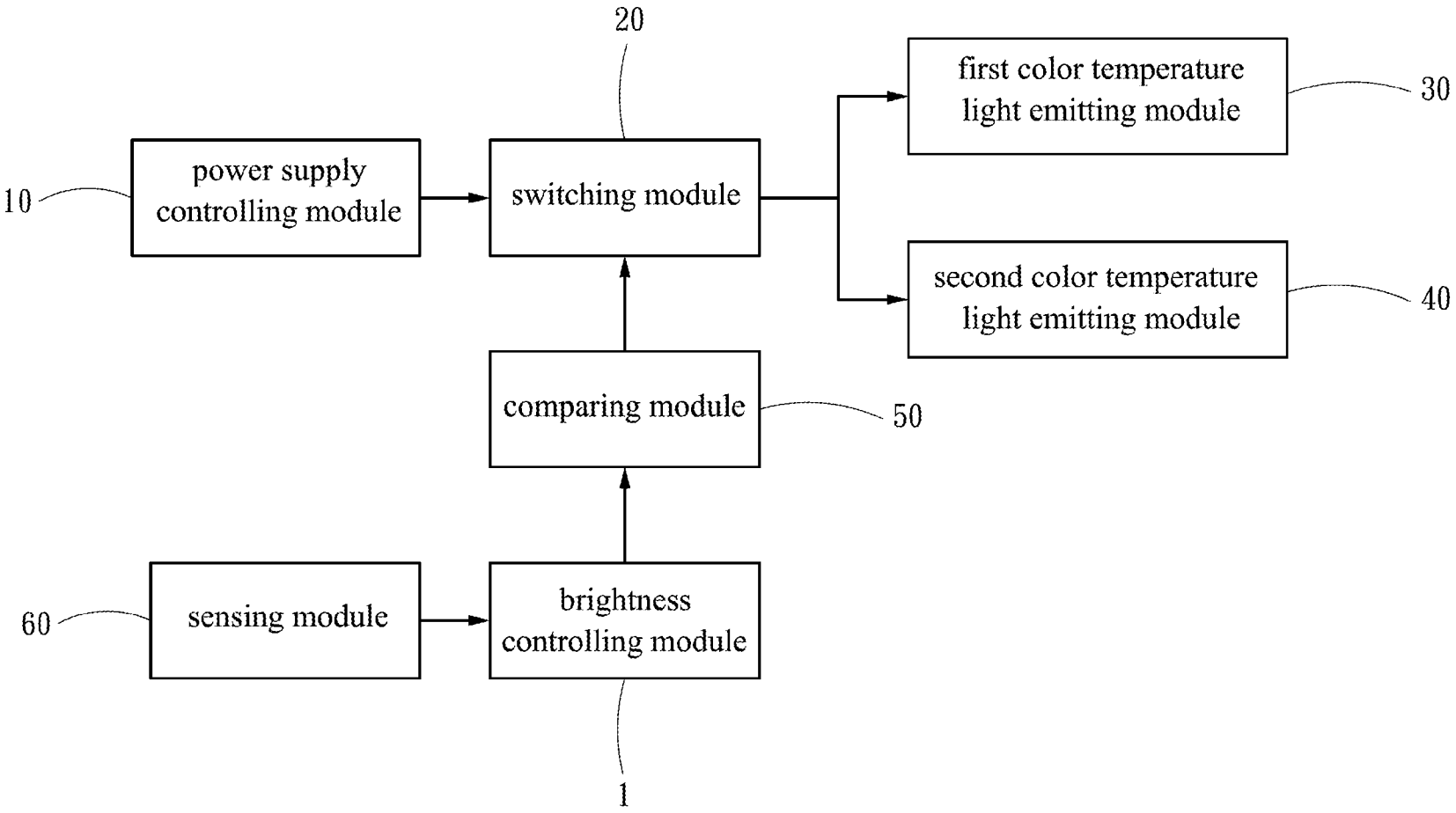
FIG. 1 is a function block diagram of a preferred embodiment of the present invention.
Figure 2:
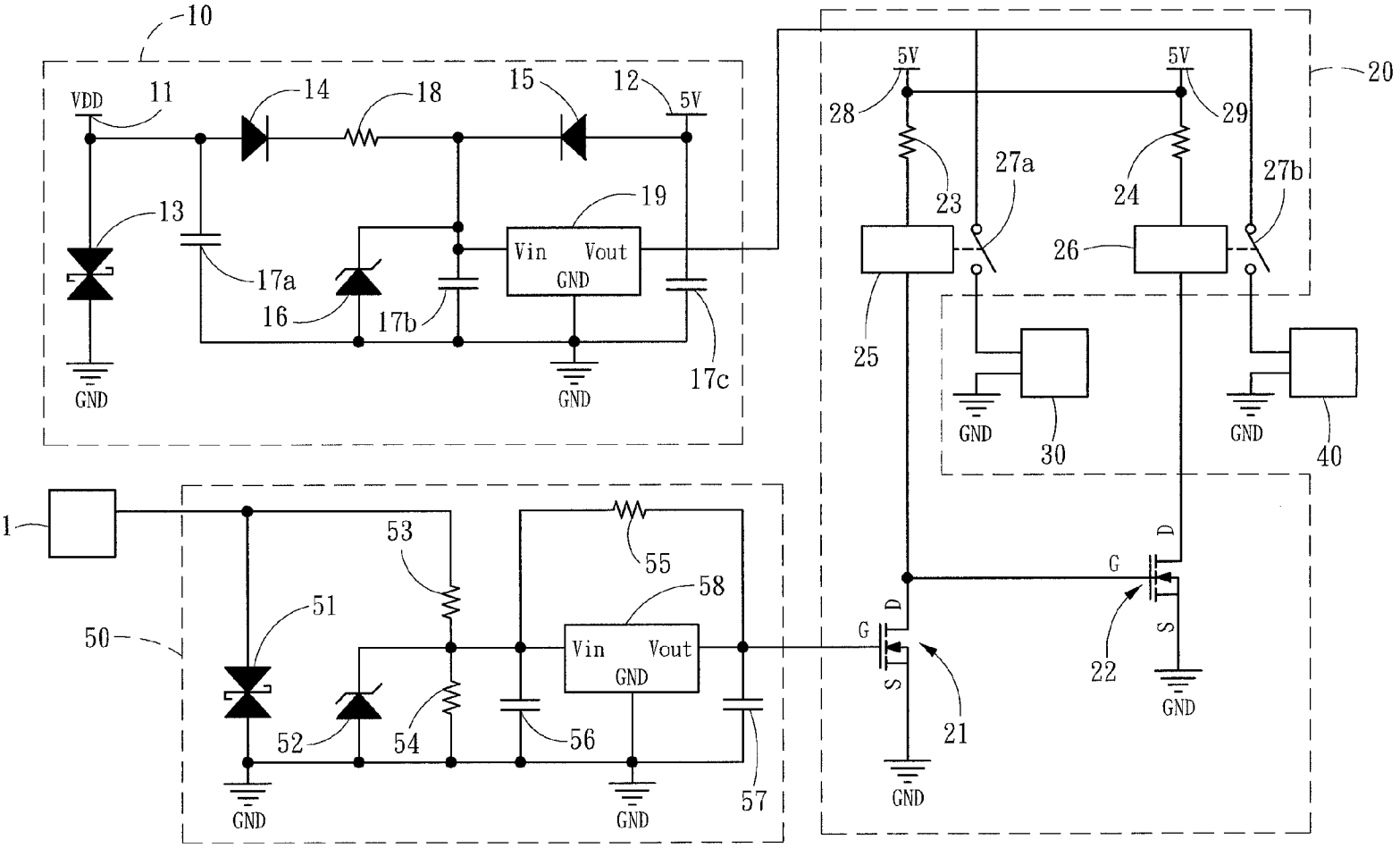
FIG. 2 is a circuit diagram of a preferred embodiment of the present invention.
Figure 3:
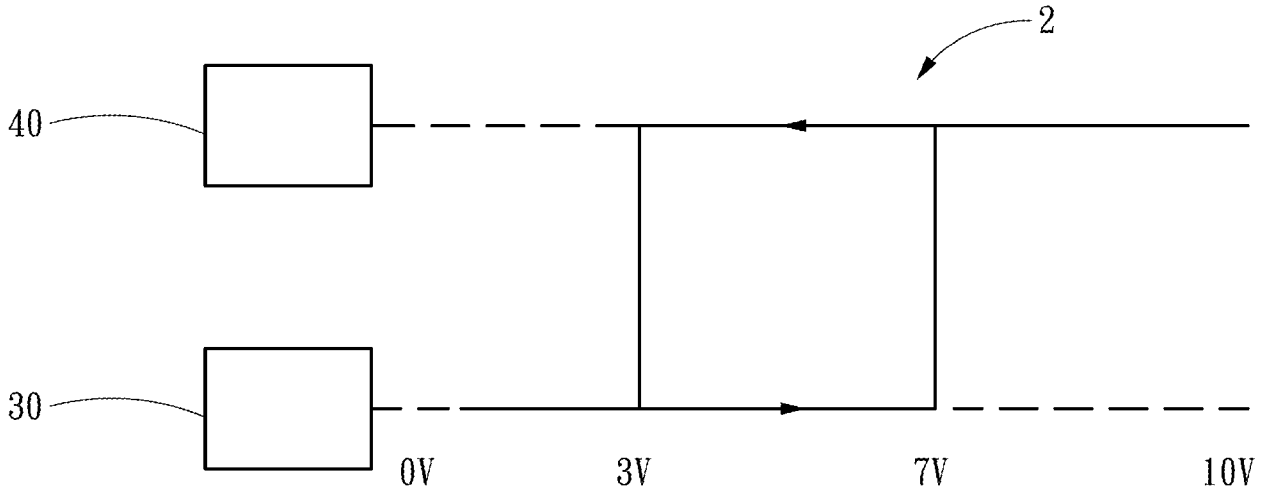
FIG. 3 is a switching loop diagram of a preferred embodiment of the present invention.

Referring to FIGS. 1 to 3, the present invention is related to a dual color temperature-controlling system mounted on a street light and electrically connected to a brightness controlling module 1 of the street light. The brightness controlling module 1 is allowed for controlling the brightness of the street light depending on the external environment. Further, the dual color temperature-controlling system includes a power supply controlling module 10, a switching module 20, a first color temperature light emitting module 30, a second color temperature light emitting module 40 and a comparing module 50. The switching module 20 is electrically connected to the power supply controlling module 10. The first color temperature light emitting module 30 and the second color temperature light emitting module 40 are electrically connected to the switching module 20. The comparing module 50 is electrically connected to the switching module 20 and the brightness controlling module 1. In this case, the first color temperature light emitting module 30 may be operated for high color temperature, while the second color temperature light emitting module 40 may be operated for low color temperature, but not limited thereto.

A voltage-type operating signal 2 is sent from the brightness controlling module 1. After the voltage-type operating signal is received by the comparing module 50 for comparison, a switching signal is sent from the comparing module to the switching module 20. The switching module 20 is switched for lighting up the first color temperature light emitting module 30, or for lighting up the second color temperature light emitting module 40 depending on the switching signal, such that color temperature of the street light is changed according to the external environment, so as to enhance safety of road occupant. Moreover, the brightness controlling module 1 originally provided in the street light may be utilized for the modulation of color temperature without additional modules, so as to reduce the cost.

In this embodiment, the power supply controlling module 10 includes a first voltage source 11, a second voltage source 12, a first voltage stabilizer 13, a first diode 14, a second diode 15, a first Zener diode 16, a first capacitor 17*a*, a second capacitor 17*b*, a third capacitor 17*c*, a first resistor 18, and a voltage regulator 19. The anode of the first diode 14 is electrically connected to the first voltage source 11, and the cathode of the first diode 14 is electrically connected to the first resistor 18. The first voltage stabilizer 13 is a transient voltage suppressor (abbreviated as TVS), two ends of which are electrically connected to the first voltage source 11 and grounded, respectively. The first capacitor 17*a* is electrically connected at two ends thereof to the anode of the first diode 14 and to the anode of the first Zener diode 16, respectively. The anode of the second diode 15 is electrically connected to the second voltage source 12, and the cathode of the second diode 15 is electrically connected to the first resistor 18. The cathode of the first Zener diode 16 is electrically connected to the cathode of the second diode 15. The second capacitor 17*b* is electrically connected at two ends thereof to the anode of the first Zener diode 16 and the cathode of the second diode 15, respectively. The voltage input terminal of the voltage regulator 19 is electrically connected to the cathode of the second diode 15, and the voltage output terminal of the voltage regulator 19 is electrically connected to the first color temperature light emitting module 30 and the second color temperature light emitting module 40. The ground terminal of the voltage regulator 19 and the anode of the first Zener diode 16 are electrically connected to each other and grounded. The third capacitor 17*c* is electrically connected at two ends thereof to the second voltage source 12 and to the second capacitor 17*b*, respectively. Further, in this embodiment, the voltage regulator 19 is produced by Texas Instruments, model no. LM2936HV.

Further, the comparing module 50 includes a second voltage stabilizer 51, a second Zener diode 52, a second resistor 53, a third resistor 54, a fourth resistor 55, a fourth capacitor 56, a fifth capacitor 57 and a voltage detector 58. The second voltage stabilizer 51 is also a TVS, two ends of which are electrically connected to the brightness controlling module 1 and grounded, respectively. The cathode of the second Zener diode 52 is electrically connected to the voltage input terminal of the voltage detector 58, and the anode of the second Zener diode 52 is grounded. The second resistor 53 is electrically connected at two ends thereof to the brightness controlling module 1 and to the cathode of the second Zener diode 52, respectively. The third resistor 54 is electrically connected at two ends thereof to the cathode of the second Zener diode 52 and to the ground, respectively. The fourth resistor 55 is electrically connected at two ends thereof to the voltage input terminal of the voltage detector 58 and to the voltage output terminal of the voltage detector 58, respectively. The fourth capacitor 56 is electrically connected at two ends thereof to the voltage input terminal of the voltage detector 58 and to the ground, respectively. The fifth capacitor 57 is electrically connected at two ends thereof to the voltage output terminal of the voltage detector 58 and to the ground, respectively. The voltage output terminal of the voltage detector 58 is electrically connected to the switching module 20, and the ground terminal of the voltage detector 58 is grounded. In this embodiment, the voltage detector 58 is produced by ROHM Semiconductor, model no. BD4827G.

In addition, the switching module 20 includes a first N-MOSFET 21, a second N-MOSFET 22, a fifth resistor 23, a sixth resistor 24, a first switching unit 25, a second switching unit 26, a first switch 27*a*, a second switch 27*b*, a fourth voltage source 28 and a fifth voltage source 29. The gate of the first N-MOSFET 21 is electrically connected to the comparing module 50, while the drain of the first N-MOSFET 21 is electrically connected to the gate of the second N-MOSFET 22 and the first switching unit 25. The source of the first N-MOSFET 21 is grounded. The fifth resistor 23 is electrically connected at two ends thereof to the fourth voltage source 28 and to the first switching unit 25, respectively. The first switch 27*a* is electrically connected to the power supply controlling module 10, the first switching unit 25 and the first color temperature light emitting module 30. The sixth resistor 24 is electrically connected at two ends thereof to the fifth voltage source 29 and to the second switching unit 26, respectively. The drain of the second N-MOSFET 22 is electrically connected to the second switching unit 26, and the source of the second N-MOSFET 22 is grounded. The second switch 27*b* is electrically connected to the power supply controlling module 10, the second switching unit 26 and the second color temperature light emitting module 40. In this embodiment, the fourth voltage source 28 and the fifth voltage source 29 are electrically connected to each other.

Referring to FIG. 3 together, a method of switchingly lighting up the first color temperature light emitting module 30 or the second color temperature light emitting module 40 of the present invention is described in more detail. Firstly, the voltage-type operating signal 2 is switched in a voltage range having a low voltage value and a high voltage value. The comparing module 50 is a window voltage detector 58, having a first switching voltage value and a second switching voltage value between the low voltage value and the high voltage value. The first switching voltage value is lower than the second switching voltage value. In this embodiment, the voltage range is laid between 0 volts (V) and 10 volts (V), i.e., the low voltage value of 0 volts (V) and the high voltage value of 10 volts (V). Moreover, the first switching voltage value is set as 3 volts (V), while the second switching voltage value is set as 7 volts (V).

When the voltage-type operating signal 2 oscillates between the low voltage value and the second switching voltage value, a first switching signal of the switching signal is outputted from the comparing module 50 to the switching module 20, and the switching module 20 is then switched for lighting up the first color temperature light emitting module 30. Further, when the voltage-type operating signal 2 exceeds the second switching voltage value, a second switching signal of the switching signal is outputted from the comparing module 50 to the switching module 20 for switchingly lighting up the second color temperature light emitting module 40. Afterward, when the voltage-type operating signal 2 oscillates between the high voltage value and the first switching voltage value, the second switching signal is still outputted from the comparing module 50 to the switching module 20 for lighting up the second color temperature light emitting module 40. When the voltage-type operating signal 2 is lower than the first switching voltage value, however, the output of the comparing module 50 to the switching module 20 is then turned into the first switching signal, such that the switching module 20 is switched for lighting up the first color temperature light emitting module 30. The purpose of this design is to prevent the problem of liability for damage due to switching between the first color temperature light emitting module 30 and the second color temperature light emitting module 40 unduly frequently because of repeated oscillation of the voltage-type operating signal 2 around the first switching voltage value or the second switching voltage value.

In more detail, when the first switching signal is received by the switching module 20, the first N-MOSFET 21 is turned on, while the second N-MOSFET 22 is tuned off. Moreover, the first switching unit 25 is allowed for switching the first switch 27*a* to be shorted, and then lighting up the first color temperature light emitting module 30. Further, when the second switching signal is received by the switching module 20, the first N-MOSFET 21 is turned off, while the second N-MOSFET 22 is turned on. Moreover, the second switching unit 26 is allowed for switching the second switch 27*b* to be shorted, and lighting up the second color temperature light emitting module 40.

In this embodiment, additionally, a sensing module 60 may be further provided. The sensing module 60 is electrically connected to the brightness controlling module 1, and may be used for sensing the external environment. After sensing the external environment, the sensing module 60 is allowed for sending a sensing signal to the brightness controlling module 1. The voltage-type operating signal 2 is further adjusted by the brightness controlling module 1 depending on the sensing signal, such that the modulated color temperature is capable of conforming to the current environment. Furthermore, the sensing module 60 may be the brightness, humidity, temperature and the like sensing module.

To sum up, the present invention is provided with features as follows:

1. The brightness controlling module originally provided in the street light is used for the modulation of color temperature without additional modules, so as to reduce the cost.

2. The problem of liability for damage due to switching between the first color temperature light emitting module and the second color temperature light emitting module unduly frequently may be prevented through providing the comparing module.

3. The external environment may be further sensed through providing the sensing module, such that color temperature emitted from the street light is capable of conforming to the current environment even more.

4. Color temperature of the street light may be changed according to the external environment through providing the first color temperature light emitting module and the second color temperature light emitting module, for the enhancement of safety of road occupant.

What is claimed is:

1. A dual color temperature-controlling system, mounted on a street light and electrically connected to a brightness controlling module of said street light, said dual color temperature-controlling system comprising:

a power supply controlling module;

a switching module electrically connected to said power supply controlling module;

a first color temperature light emitting module electrically connected to said switching module;

a second color temperature light emitting module electrically connected to said switching module;

a comparing module electrically connected to said switching module and said brightness controlling module; and a sensing module electrically connected to said brightness controlling module, said sensing module sending a sensing signal to said brightness controlling module, said brightness controlling module adjusting said voltage-type operating signal depending on said sensing signal;

wherein a voltage-type operating signal sent from said brightness controlling module is received by said comparing module for comparison, and a switching signal is then sent from said comparing module to said switching module, said switching module being switched for lighting up said first color temperature light emitting module, or for lighting up said second color temperature light emitting module depending on said switching signal.

2. The dual color temperature-controlling system according to claim 1, wherein said voltage-type operating signal is laid in a voltage range having a low voltage value and a high voltage value, said comparing module being a window comparator, having a first switching voltage value and a second switching voltage value between said low voltage value and said high voltage value, said first switching voltage value being lower than said second switching voltage value;

when said voltage-type operating signal being laid between said low voltage value and said second switching voltage value, a first switching signal of said switching signal being outputted from said comparing module to said switching module, and said switching module being then switched for lighting up said first color temperature light emitting module, while when said voltage-type operating signal exceeding said second switching voltage value, a second switching signal of said switching signal being outputted from said comparing module to said switching module for switchingly lighting up said second color temperature light emitting module, afterward when said voltage-type operating signal being laid between said high voltage value and said first switching voltage value, said second switching signal being outputted from said comparing module to said switching module for switchingly lighting up said second color temperature light emitting module, while when said voltage-type operating signal being lower than said first switching voltage value, said first switching signal being outputted from said comparing module to said switching module for switchingly lighting up said first color temperature light emitting module.

3. The dual color temperature-controlling system according to claim 2, wherein said switching module comprises a first N-MOSFET, a second N-MOSFET, a fifth resistor, a sixth resistor, a first switching unit, a second switching unit, a first switch, a second switch, a fourth voltage source and a fifth voltage source, the gate of said first N-MOSFET being electrically connected to said comparing module, the drain of said first N-MOSFET being electrically connected to the gate of said second N-MOSFET and said first switching unit, the source of said first N-MOSFET being grounded, said fifth resistor being electrically connected at two ends thereof to said fourth voltage source and to said first switching unit, respectively, said first switch being electrically connected to said power supply controlling module, said first switching unit and said first color temperature light emitting module, said sixth resistor being electrically connected at two ends thereof to said fifth voltage source and to said second switching unit, respectively, the drain of said second N-MOSFET being electrically connected to said second switching unit and the source of said second N-MOSFET being grounded, said second switch being electrically connected to said power supply controlling module, said second switching unit and said second color temperature light emitting module;

after said first switching signal being received by said switching module, said first N-MOSFET being turned on, while said second N-MOSFET being tuned off, said first switching unit switching said first switch to be shorted so as to light up said first color temperature light emitting module; after said second switching signal being received by said switching module, said first N-MOSFET being turned off, while said second N-MOSFET being turned on, said second switching unit switching said second switch to be shorted so as to light up said second color temperature light emitting module.

4. The dual color temperature-controlling system according to claim 2, wherein said voltage range is laid between 0 volts and 10 volts.

5. The dual color temperature-controlling system according to claim 1, wherein said power supply controlling module comprises a first voltage source, a second voltage source, a first voltage stabilizer, a first diode, a second diode, a first Zener diode, a first capacitor, a second capacitor, a third capacitor, a first resistor and a voltage regulator, the anode of said first diode being electrically connected to said first voltage source, and the cathode of said first diode being electrically connected to said first resistor, said first voltage stabilizer being electrically connected at two ends thereof to said first voltage source and to the ground, respectively, said first capacitor being electrically connected at two ends thereof to the anode of said first diode and to the anode of said first Zener diode, respectively, the anode of said second diode being electrically connected to said second voltage source, and the cathode of said second diode being electrically connected to said first resistor, the cathode of said first Zener diode being electrically connected to the cathode of said second diode, said second capacitor being electrically connected at two end thereof to the anode of said first Zener diode and the cathode of said second diode, respectively, the voltage input terminal of said voltage regulator being electrically connected to the cathode of said second diode, and the voltage output terminal of said voltage regulator being electrically connected to said first color temperature light emitting module and said second color temperature light emitting module, the ground terminal of said voltage regulator and the anode of said first Zener diode being electrically connected to each other and grounded, said third capacitor being electrically connected at two ends thereof to said second voltage source and to said second capacitor, respectively.

6. The dual color temperature-controlling system according to claim 1, wherein said comparing module comprises a second voltage stabilizer, a second Zener diode, a second resistor, a third resistor, a fourth resistor, a fourth capacitor, a fifth capacitor and a comparator, said second voltage stabilizer being electrically connected at two ends thereof to said brightness controlling module and to the ground, respectively, the cathode of said second Zener diode being electrically connected to the voltage input terminal of said comparator, and the anode of said second Zener diode being grounded, said second resistor being electrically connected at two ends thereof to said brightness controlling module and to the cathode of said second Zener diode, respectively, said third resistor being electrically connected at two ends thereof to the cathode of said second Zener diode and to the ground, respectively, said fourth resistor being electrically connected at two ends thereof to the voltage input terminal of said comparator and to the voltage output terminal of said comparator, respectively, said fourth capacitor being electrically connected at two ends thereof to the voltage input terminal of said comparator and to the ground, respectively, said fifth capacitor being electrically connected at two ends thereof to the voltage output terminal of said comparator and to the ground, respectively, the voltage output terminal of said comparator being electrically connected to said switching module, and the ground terminal of said comparator being grounded.

* * * * *